US005520831A

United States Patent [19]

Nibert et al.

[11] Patent Number: 5,520,831

[45] Date of Patent: May 28, 1996

[54] INCREASING THE FRICTION DURABILITY OF POWER TRANSMISSION FLUIDS THROUGH THE USE OF OIL SOLUBLE COMPETING ADDITIVES

[75] Inventors: Roger K. Nibert, Hampton; Ricardo A. Bloch, Scotch Plains; Jack Ryer, East Brunswick; Raymond F. Watts, Long Valley, all of N.J.

[73] Assignee: Exxon Chemical Patents Inc., Linden, N.J.

[21] Appl. No.: 170,469

[22] Filed: Dec. 20, 1993

[51] Int. Cl.[6] ..... C10M 133/02

[52] U.S. Cl. ..... 252/51.5 R; 252/51.5 A

[58] Field of Search ..... 252/51.5 R, 51.5 A

[56] References Cited

U.S. PATENT DOCUMENTS

| | | | |
|---|---|---|---|
| 3,809,651 | 5/1974 | Crawford et al. | 252/47.5 |
| 3,873,460 | 3/1975 | Coon et al. | 252/51.5 A |
| 3,879,306 | 4/1975 | Kablaoui et al. | 252/51.5 A |
| 3,972,243 | 8/1976 | Driscoll et al. | 74/200 |
| 4,094,800 | 6/1978 | Warne | 252/32.7 E |
| 4,101,429 | 7/1978 | Birke | 252/32.7 E |
| 4,253,977 | 3/1981 | O'Halloran | 252/33.4 |
| 4,256,595 | 3/1981 | Sung et al. | 252/51.5 A |
| 4,486,324 | 12/1984 | Korosec | 252/49.3 |
| 4,563,293 | 1/1986 | Small, Jr. | 252/32.7 E |
| 4,629,576 | 12/1986 | Small, Jr. | 252/32.7 E |
| 4,663,063 | 5/1987 | Davis | 252/51.5 R |
| 4,704,217 | 11/1987 | Sweeney et al. | 252/32.7 E |
| 4,755,311 | 7/1988 | Burjes et al. | 252/49.9 |
| 4,772,739 | 9/1988 | Forsberg | 558/208 |
| 4,792,410 | 12/1988 | Schwind et al. | 252/38 |
| 4,795,583 | 1/1989 | Papay | 252/77 |
| 4,971,598 | 11/1990 | Andress et al. | 44/57 |
| 4,973,789 | 11/1990 | Karn et al. | 585/525 |
| 5,282,990 | 2/1994 | Yoneto et al. | 252/51.5 R |
| 5,320,768 | 6/1994 | Gutierrez et al. | 252/51.5 R |
| 5,372,735 | 12/1994 | Ohtani et al. | 252/51.5 R |

FOREIGN PATENT DOCUMENTS

| | | | |
|---|---|---|---|
| 0351964A1 | 1/1990 | European Pat. Off. | C10M 141/10 |
| 0393769A1 | 10/1990 | European Pat. Off. . | |
| 0407124A1 | 1/1991 | European Pat. Off. | C10M 141/10 |
| 0544298A1 | 6/1993 | European Pat. Off. | C10M 163/00 |
| 1087039 | 10/1967 | United Kingdom . | |
| 2085918 | 5/1982 | United Kingdom | C10M 1/38 |
| WO87/07637 | 12/1987 | WIPO . | |
| WO92/02602 | 2/1992 | WIPO | C10M 133/02 |

*Primary Examiner*—Jacqueline V. Howard
*Attorney, Agent, or Firm*—T. J. Shatynski

[57] ABSTRACT

A method of controlling the friction coefficients and improving the friction durability of an oleaginous compositions, such as an ATF, comprising adding to the composition a combination of competing additives comprising (a) at least one friction reducing chemical additive having a polar head group other than a dialkoxylated amino group and a friction reducing substituent group, and at least one non-friction reducing additive (b) having a dialkoxylated amino polar head group and having a substituent group which has no material friction raising or lowering effect (non-friction reducing additive) on the composition.

9 Claims, 3 Drawing Sheets

INCREASING THE FRICTION DURABILITY OF POWER TRANSMISSION FLUIDS THROUGH THE USE OF OIL SOLUBLE COMPETING ADDITIVES

BACKGROUND OF THE INVENTION

1. Field of the Invention

The present invention relates to a method of and compositions for improving the friction durability of power transmission fluids.

2. Description of Related Prior Art

Power transmission fluids, such as automatic transmission fluids, are formulated to very exacting friction requirements set by original equipment manufacturers. These requirements have two primary aspects, namely: (1) the absolute level of the friction coefficients, i.e., static friction, $\mu_S$, and dynamic friction, $\mu_D$, that can be achieved by these fluids, and (2) the length of time that these fluids can be used without undergoing an appreciable change in the friction coefficients. This latter performance feature is also known as friction durability.

Since friction durability is a function of the type and concentration of friction modifier molecules present in a given fluid, such as a power transmission fluid, conventionally there are only limited ways of improving friction durability. One of these ways is to add more friction modifier, i.e., to increase the concentration of friction modifier in the fluid. Since friction modifiers are consumed at a somewhat fixed rate, this will prolong the effective life of the fluid. However, this approach often is not very practical because increasing the concentration of the friction modifier usually will result in a lowering of the absolute values of the friction coefficients to a point where they are below the minimum values specified by the original equipment manufacturer. Then, as the friction modifier is consumed with time, the friction coefficients will slowly rise to unacceptable levels. The other conventional approach for improving friction durability is to find more stable friction modifiers. This is not always easy since most friction modifiers are simple organic chemicals and are subject to oxidation and chemical reactions during service.

Various compositions and methods have been suggested for modifying the properties of oleaginous fluids. For example, U.S. Pat. No. 4,253,977 relates to an ATF composition which comprises a friction modifier such as n-octadecyl succinic acid or the reaction product of an alkyl or alkenyl succinic anhydride with an aldehyde/tris hydroxymethyl aminomethane adduct and an overbased alkali or alkaline earth metal detergent. The ATF may also contain a conventional hydrocarbyl-substituted succinimide ashless dispersant such as polyisobutenyl succinimide. Other patents which disclose ATF compositions that include conventional alkenyl succinimide dispersants include, for example, U.S. Pat. Nos. 3,879,306; 3,920,562; 3,933,659; 4,010,106; 4,136,043; 4,153,567; 4,159,956; 4,596,663 and 4,857,217; British Patents 1,087,039; 1,474,048 and 2,094,339; European Patent Application 0,208,541(A2); and PCT Application WO 87/07637.

U.S. Pat. No. 3,972,243 discloses traction drive fluids which comprise gem-structured polyisobutylene oligomers. Polar derivatives of such gem-structured polyisobutylenes can be obtained by conversion of the polyisobutylene oligomers to polar compounds containing such functional groups as amine, imine, thioketone, amide, ether, oxime, maleic anhydride, etc. adducts. The polyisobutylene oligomers generally contain from about 16 to about 48 carbon atoms. Example 18 of this patent discloses reacting a polyisobutylene oil with maleic anhydride to form a polyisobutylene succinic anhydride which is useful as a detergent, as an anti-wear agent, and as an intermediate in the production of a hydrazide derivative. Other patents containing similar disclosures include, for example, U.S. Pat. No. 3,972,941; U.S. Pat. No. 3,793,203; U.S. Pat. No. 3,778,487 and U.S. Pat. No. 3,775,503.

While the prior art suggests a variety of additives for modifying the properties of various oleaginous compositions, there is no suggestion of any additives, nor of any combination of additives, which can simultaneously control the friction coefficients and friction durability of such compositions. Accordingly, there is a continuing need for new additives, as well as new methods, which would enable the formulation of oleaginous compositions, including lubricating oils and power transmission fluids, having specifically controlled friction coefficients and improved friction durability.

SUMMARY OF THE INVENTION

In one embodiment, the invention relates to a method of controlling the friction coefficients and improving the friction durability of an oleaginous composition, which compromises:

adding to a major portion of an oil of lubricating viscosity a friction controlling and friction durability improving effective amount of an oil soluble combination of chemical additives comprising (a) a first chemical additive comprising a first polar head group other than a dialkoxylated amino group and a friction reducing substituent group, and (b) at least one other chemical additive having a dialkoxylated amino polar head group and a non-friction reducing substituent group.

DETAILED DESCRIPTION OF THE INVENTION

Figure 1:
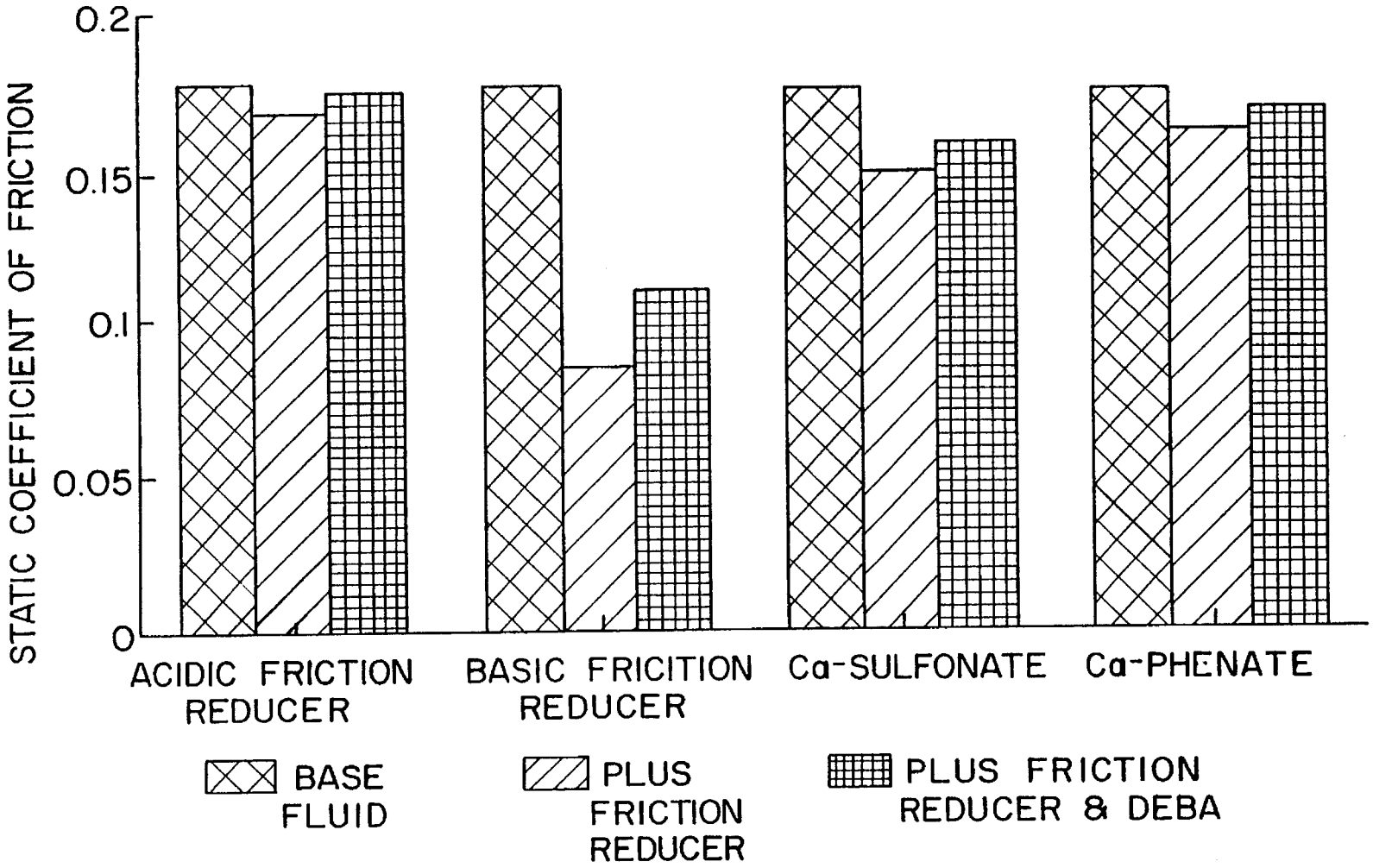
FIG. 1 is a bar graph illustrating the static coefficient of friction, determined at 93° C., using a Low Velocity Friction Apparatus (LVFA), for (1) a base fluid, (2) the base fluid plus a friction reducer and (3) the base fluid plus a combination of a friction reducer and diethoxylated-n-butylamine (DEBA) as a non-friction reducing additive.

A primary advantage of the present invention is that it enables the fluid formulator to increase the concentration of the active friction reducer without reducing the absolute values of the friction coefficients to a point below the minimum specified by the original equipment manufacturer.

This is accomplished by placing in the oleaginous composition, such as an automatic transmission fluid, a friction reducing chemical additive (Component A) and a non-friction reducing chemical additive containing a dialkoxylated amino polar head group (Component B). For example, a long chain carboxylic acid, such as oleic acid or isostearic acid, or a branched chain hydrocarbyl substituted amide, such as the reaction product of isostearic acid and tetraethylene pentamine (TEPA), can be added as a friction reducing additive along with an ethoxylated butylamine amine non-friction reducing additive.

While not wishing to be bound by a particular theory, it is believed that once in the fluid, the two chemical additives compete for the surfaces which are contacted. Accordingly, not all of the friction reducing additive will contact the surfaces even if there is an excess of friction reducer in the fluid. This enables the formulator to intentionally add more friction reducing additive to the fluid than could normally be tolerated without lowering the friction coefficients to a level below the minimum specified by the original equipment manufacturer. Then, as the additives which are in contact with the surfaces are slowly consumed, an additional portion of the excess friction reducer and competing dialkoxylated amine originally present in the fluid can come in contact with the surfaces, thereby maintaining the friction coefficients at the desired levels. Thus, by adding the friction reducing chemical additive and the dialkoxylated amino group containing non-friction reducing chemical additive in an appropriate ratio, the friction coefficients of the resulting fluid will remain essentially constant over a long period of use, i.e., the fluid will exhibit a substantially improved friction durability relative to fluids containing only a friction reducing chemical additive or only a non-friction reducing additive.

Component A

The oil soluble friction reducing additives (Component A) contemplated for use in this invention comprise any of those chemical additives conventionally employed for reducing the friction coefficients of oleaginous fluids to which they are added. Typically, such friction reducing additives comprise a polar head group and a friction reducing substituent group which is linked to the polar head group.

The friction reducing substituent group normally would comprise a substantially linear hydrocarbyl group having at least about 10 carbon atoms, typically from about 10 to about 30 carbon atoms, and preferably from about 14 to about 18 carbon atoms. Examples of such linear hydrocarbyl groups include, but are not limited to oleyl, isostearyl and octadecenyl groups.

The polar head groups which are contemplated for use in the present invention vary widely and include any polar group, other than a dialkoxylated amino group, which is conventionally present in a friction reducing additives. Typically, however, the polar head groups present in the friction reducing additives contemplated for use in this invention include, for example, polar head groups having the following moieties:

$-COOH$, $-CONH_2$, $-CONH-(CH_2CH_2NH)_xC(O)R$, $-P(OR)_2$,

-continued

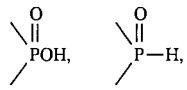

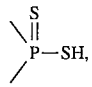

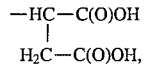

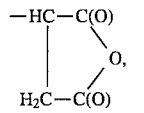

$-SH$, $-SO_2H$, and $-SO_3H$ wherein R represents a $C_1$ to $C_{30}$ linear or branched hydrocarbyl group and x represents an integer of from 1 to about 8.

In one aspect, the friction reducing additive may be represented by formula I:

$$A-L-P \quad . \qquad (I)$$

wherein A represents a substantially linear, long chain hydrocarbyl group; L represents a linking group; and P represents a polar head group, preferably a nitrogen-containing polar head group.

The linear hydrocarbyl group A typically contains from about 12 to about 50 carbon atoms and typically has a molecular weight on the order of from about 150 to about 700.

Suitable hydrocarbyl groups include alkyl and alkenyl groups, such as oleyl, octadecyl, octadecenyl, isostearyl, and hetero atom-containing analogs thereof. atoms. A variety of hetero can be used and are readily apparent to those skilled in the art. Suitable hetero atoms include, but are not limited to, nitrogen, oxygen, phosphorus, and sulfur. Preferred hetero atoms are sulfur and oxygen. Suitable linear hydrocarbyl groups include, for example, hexadecyloxypropyl, octadecylthiapropyl, hexadecyloxyethyl and tetradecyloxgethyl.

The linking group typically is derived from a monounsaturated carboxylic reactant comprising at least one member selected from the group consisting of (i) monounsaturated $C_4$ to $C_{10}$ dicarboxylic acid wherein (a) the carboxyl groups are vicinyl, (i.e. located on adjacent carbon atoms) and (b) at least one, preferably both, of said adjacent carbon atoms is part of said monounsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is allylic to the carboxyl group, i.e., of the structure

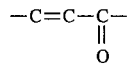

and (iv) derivatives of (iii) such as $C_1$ to $C_5$ alcohol derived mono- or diesters of (iii). Upon reaction with the linear hydrocarbyl group reactant, the monounsaturation of the carboxylic reactant becomes saturated. Thus, for example, maleic anhydride becomes a linear hydrocarbyl group substituted succinic anhydride, and acrylic acid becomes a linear hydrocarbyl substituted propionic acid.

Exemplary of such monounsaturated carboxylic reactants are fumaric acid, itaconic acid, itaconic anhydride, maleic acid, maleic anhydride, chloromaleic acid, chloromaleic anhydride, acrylic acid, methacrylic acid, crotonic acid, hemic anhydride, cinnamic acid, and lower alkyl (e.g., $C_1$ to $C_4$ alkyl) acid esters of the foregoing, e.g., methyl maleate, ethyl fumarate, methyl fumarate, etc.

Maleic anhydride or a derivative thereof is preferred as it does not homopolymerize appreciably, but attaches onto the linear hydrocarbyl group to give two carboxylic acid functionalities. Such preferred materials have the generic formula II:

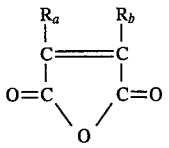

(II)

wherein $R_a$ and $R_b$ are hydrogen or a halogen.

In addition to the unsaturated carboxylic acid materials described above, the linking group may comprise the residue of a functionalized aromatic compound, such as a phenol or a benzene sulfonic acid. Thus, in one preferred aspect of the invention, the linking group may be illustrated by formula III:

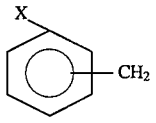

(III)

wherein X is a functional group such as OH, Cl or $SO_3H$.

In such cases, the friction reducers may be prepared, for example, by a conventional Mannich Base condensation of aidehyde, (e.g., formaldehyde), polar group precursor (e.g. alkylene polyamine) and hydrocarbyl group substituted phenol. The following U.S. patents contain extensive disclosures relative to the production of Mannich condensates and to that extent, these patents are incorporated herein by reference: 2,459,112; 2,962,442; 3,355,270; 3,448,047; 3,600,372, 3,649,729 and 4,100,082.

Sulfur-containing Mannich condensates also may be used and such condensates are described, for example, in U.S. Pat. Nos. 3,368,972; 3,649,229; 3,600,372; 3,649,659 and 3,741,896. These patents are incorporated herein by reference to the extent that they disclose sulfur-containing Mannich condensates. Generally, the condensates useful in this invention are those made from a phenol having a linear hydrocarbyl substituent of at least about 10, typically about 10 to about 50 carbon atoms, more typically, 12 to about 36 carbon atoms. Typically these condensates are made from formaldehyde or a $C_2$ to $C_7$ aliphatic aldehyde and an amino compound.

These Mannich condensates are prepared by reacting about one molar portion of linear hydrocarbyl substituted phenolic compound with about 1 to about 2.5 molar portions of aldehyde and about 1 to about 5 equivalent portions of amino compound (an equivalent of amino compound is its molecular weight divided by the number of >NH groups present). The conditions under which the condensation reactions are carried out are well known to those skilled in the art as evidenced by the above-noted patents. Accordingly, the above-noted patents are incorporated by reference for their disclosures relating to reaction conditions.

As indicated above, the polar head group may vary widely and typically comprises the residue of an amine compound, i.e. polar group precursor, containing at least 1, typically 2 to 60, and preferably 2 to 40 total carbon atoms, and at least 1, typically 2 to 15, and preferably 2 to 9 nitrogen atoms, with at least one nitrogen atom preferably being present in a primary or secondary amine group. The amine compounds may be hydrocarbyl amines or may be hydrocarbyl amines including other groups, e.g., hydroxy groups, alkoxy groups, amide groups, nitrile groups, imidazole groups, morpholine groups or the like. The amine compounds also may contain 1 or more boron or sulfur atoms, provided that such atoms do not interfere with the substantially polar nature and function of the selected polyamine. It is to be understood, however, that the polar groups contemplated for use in this invention may not comprise dialkoxylated amino groups.

Useful amines include those of formulas IV and V:

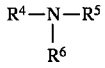

(IV)

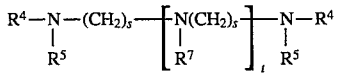

(V)

wherein $R^4$, $R^5$, $R^6$ and $R^7$ are independently selected from the group consisting of hydrogen, $C_1$ to $C_{25}$ linear or branched alkyl radicals, $C_1$ to $C_{12}$ alkoxy $C_2$ to $C_6$ alkylene radicals, $C_2$ to $C_{12}$ hydroxy amino alkylene radicals, and $C_1$ to $C_{12}$ alkylamino $C_2$ to $C_6$ alkylene radicals; and wherein $R^7$ can additionally comprise a moiety of the formula:

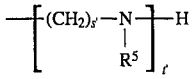

wherein $R^5$ is defined above; wherein s and s' can be the same or a different number of from 2 to 6, preferably 2 to 4; and t and t' can be the same or a different number of from 0 to 10, preferably 0 to 7 with the proviso that the sum of t and t' is not greater than 15; and with the further proviso that not more than one of $R^4$, $R^5$ and $R^6$ may comprise a $C_1$ to $C_{12}$ alkoxy $C_2$ to $C_6$ alkylene radical.

Non-limiting examples of suitable amine compounds include: 1,2-diaminoethane, 1,6-diaminohexane; polyethylene amines such as tetraethylene pentamine; polypropylene amines such as 1,2-propylene diamine; di-(1,2-propylene) diamine; di-(1,2-propylene)triamine; di-(1,3-propylene) triamine; N,N-dimethyl-1,3-diaminopropane; N,N-di(2-aminoethyl) ethylene diamine; N,N-di(2-hydroxyethyl)1,3-propylene diamine; 3-dodecyloxy-propylamine, N-dodecyl-1, 3-propane diamine, etc.

Other suitable amines include: amino morpholines such as N-(3-aminopropyl) morpholine and N-(2-aminoethyl) morpholine; substituted pyridines such as 2-amino pyridine, 2-methylamino pyridine and 2-methylamino pyridine; and others such as 2-aminothiazole; 2-amino pyrimidine; 2-amino benzothiazole; methyl-1-phenyl hydrazine and paramorpholino aniline, etc. A preferred group of aminomorpholines are those of formula VI:

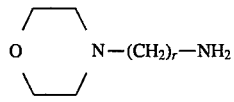

(VI)

where r is a number having a value of 1 to 5.

Useful amines also include alicyclic diamines, imidazolines and N-aminoalkyl piperazines of formula VII:

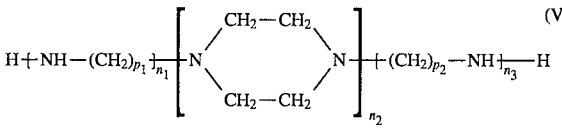

(VII)

wherein $p_1$ and $p_2$ are the same or different and each is an integer of from 1 to 4; and $n_1$, $n_2$ and $n_3$ are the same or different and each is an integer of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those having formula VIII:

$$NH_2\text{-alkylene}—(\text{O-alkylene})_m—NH_2, \quad \text{(VIII)}$$

wherein m has a value of at least 3 and "alkylene" represents a linear or branched chain $C_2$ to $C_7$, preferably $C_2$ to $C_4$ alkylene radical; or formula IX:

$$R^8\text{-(alkylene—(O-alkylene )}_m—NH_2)_a, \quad \text{(IX)}$$

wherein $R^8$ is a polyvalent saturated hydrocarbon radical having up to 10 carbon atoms and the number of substituents on the $R^8$ group is represented by the value of "a", which is a number of from 3 to 6, wherein m' has a value of at least 1; and wherein "alkylene" represents a linear or branched chain $C_2$ to $C_7$, preferably $C_2$ to $C_4$ alkylene radical.

The polyoxyalkylene polyamines of formulas (VIII) or (IX) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene polyamines. The polyoxyalkylene polyamines are commercially available and may be obtained, for example, from the Jefferson Chemical Company, Inc. under the trade name "Jeffamines D-230, D-400, D- 1000, D-2000, T-403", etc.

The polar group may be joined to the linking group through an ester linkage when the linking group is a carboxylic acid or anhydride. To incorporate polar groups of this type, they must have a free hydroxyl group and all of the nitrogen atoms in the polar group must be tertiary nitrogen atoms. Polar groups of this type are represented by formula X:

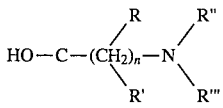

(X)

wherein n has a value of from 1 to 10, R and R' are H or $C_1$ to $C_{12}$ alkyl, and R" and R"' are $C_1$ to $C_6$ alkyl.

Forming the Friction Reducing Additives

In accordance with one aspect of the invention, the friction reducing additives may be prepared by reacting a long chain linear carboxylic acid, such as oleic acid or isostearic acid, with a polar group precursor, preferably a nitrogen-containing polar group precursor, such as tetraethylene pentamine or diethylene triamine, to form the corresponding long linear hydrocarbyl amide.

Typically, from about 5 to about 0.5, preferably from about 3 to about 1, and most preferably from about 1.5 to about 1 moles of said carboxylic acid reactant are charged to the reactor per mole of primary nitrogen contained in the polar group precursor. The long chain linear carboxylic acid reactant may be readily reacted with a polar group precursor, i.e., amine compound, by heating at a temperature of from about 100° C. to 250° C., preferably from 120° to 230° C., for a period of from about 0.5 to 10 hours, usually about 1 to about 6 hours.

Alternatively, as discussed above, the polar group precursor may be reacted with an aldehyde and a hydrocarbyl substituted phenol in a conventional manner to form Mannich condensates having friction reducing properties.

Component B

The oil soluble non-friction reducing additives (Component B) contemplated for use in this invention comprise dialkoxylated amino compounds represented by formula (XI):

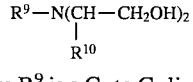

(XI)

where $R^9$ is a $C_1$ to $C_8$ linear alkyl group, $C_2$ to $C_{20}$ branched alkyl group or $—CH_2CH_2OH$; and $R^{10}$ is H or a $C_1$ to $C_6$ linear or branched alkyl group.

Typically $R^9$ is a $C_2$ to $C_6$ linear alkyl group, preferably a $C_4$ alkyl group. In a particularly preferred aspect of the invention, $R^9$ is n-butyl and $R^{10}$ is H.

Typically, for non-friction reducing additives, the long chain, linear hydrocarbyl substituent group which is present in the friction reducing additives would be replaced with a shorter chain linear or branched hydrocarbyl substituent group, e.g., one having a chain length of less than about 10 carbon atoms. Thus, hydrocarbyl groups such as butyl, hexyl or octyl would be typical of those hydrocarbyl groups that would be present in the non-friction reducing additives contemplated for use in this invention.

Representative examples of chemical additives which would be useful as the non-friction reducing additive include, but are not limited to diethoxylated butylamine and diethoxylated hexylamine.

Compositions

A minor amount, e.g., 0.01 up to about 50 wt. % preferably 0.1 to 10 wt. %, and more preferably 0.5 to 5 wt. %, of a combination of at least one friction reducing chemical additive (Component A) and at least one non-friction reducing chemical additive (Component B) and can be incorporated into a major amount of an oleaginous material, such as a lubricating oil, depending upon whether one is forming finished products or additive concentrates. The relative amounts of friction reducing additive and non-friction reducing additive can vary over wide limits depending in part upon the identity of the specific additives. However, the mole ratio of the friction reducing additive to non-friction reducing additive typically will be from about 1:99 to 99:1, and preferably from about 1:10 to 10: 1.

When used in lubricating oil compositions, e.g., automatic transmission formulations, etc. the final combined concentration of the friction reducing additive and the non-friction reducing additive typically will be in the range of from about 0.01 to 30 wt. %, e.g., 0.1 to 15 wt. %, preferably 0.5 to 10.0 wt. %, of the total composition. The lubricating oils to which the combination of additives of this invention can be added include not only hydrocarbon oils derived from petroleum, but also include synthetic lubricating oils such as esters of dicarboxylic acids; complex esters made by esterification of monocarboxylic acids, polyglycols, dicarboxylic acids and alcohols; polyolefin oils, etc.

The combination of the friction reducing additive and the non-friction reducing additive may be utilized in a concentrate form, e.g., in a minor amount from about 0.1 wt. % up to about 50 wt. %, preferably 5 to 25 wt. %, in a major amount of oil, e.g., said synthetic lubricating oil with or without additional mineral lubricating oil.

The above oil compositions may contain other conventional additives, such as ashless dispersants, for example the reaction product of polyisobutylene succinic anhydride with polyethyleneamines of 2 to 10 nitrogens, which reaction product may be borated; antiwear agents such as zinc dialkyl dithiophosphates; viscosity index improvers such as polyisobutylene, polymethacrylates, copolymers of vinyl acetate and alkyl fumarates, copolymers of methacrylates with amino methacrylates; corrosion inhibitors; oxidation inhibitors; friction modifiers; metal detergents such as overbased calcium magnesium sulfonates, phenate sulfides, etc.

The following examples, wherein all parts or percentages are by weight unless otherwise noted, which include preferred embodiments, further illustrate the present invention.

PREPARATIVE EXAMPLES

Example 1

Standard automatic transmission fluids (ATF's) were prepared for testing the friction characteristics of various combinations of friction additives. The fluids were prepared by blending the friction additives indicated in Table 1 into an additive concentrate, and then dissolving the concentrate into a mineral oil base fluid (Exxon FN 1391) to give the required concentration of additives. The basic test fluids contained approximately 10 weight % of additives, including dispersant, anti-wear agent, corrosion inhibitor, antioxidant, anti-foamant, viscosity modifier and the indicated amount of the specified friction reducing and/or non-friction reducing additive.

TABLE 1

| Test Fluid | Friction Reducing Additive, Wt. % | Non-Friction Reducing Additive, Wt. % |
|---|---|---|
| A-1 | thiobisethanol ester[1], 0.4% | NONE |
| A-2 | thiobisethanol ester, 0.4% | DEBA[2], 0.05% |
| B-1 | ISA/TEPA[3], 0.2% | NONE |
| B-2 | ISA/TEPA, 0.2% | DEBA, 0.05% |
| C-1 | Basic calcium sulfonate[4], 0.2% | NONE |
| C-2 | Basic calcium sufonate[4], 0.2% | DEBA, 0.05% |
| D-1 | Basic calcium phenate[5], 0.2% | NONE |
| D-2 | Basic calcium phenate[5], 0.2% | DEBA, 0.05% |

[1]octadecenylsuccinic acid ester of thiobisethanol
[2]diethoxylated n-butylamine
[3]isostearic acid/tetraethylene pentamine reaction product (3.1:1 mole ratio)
[4]Hitec E-611, Ethyl Corporation
[5]Paranox 52, Exxon Chemicals The static coefficient of each test fluid was determined at 93° C., using the Low Velocity Friction Apparatus (LVFA). The results of this testing are shown in FIG. 1. For each test fluid, the first bar (on left) shows the static friction coefficient of the base test fluid without any friction reducing or non-friction reducing additives (0.178). The center bar shows the static friction depression caused by the indicated friction reducing additive. The third bar shows the increase in static friction due to the addition of 0.05 mass percent of DEBA. In all cases significant increase of static friction resulted from the addition of even this small amount of DEBA. The phenomenon was observed with all types of friction reducing additives, i.e., acidic, basic, or metal containing friction reducing additives. Also the more potent the friction reducing additive, i.e., the greater the friction reduction caused by the friction reducing additive, the more pronounced was the effect caused by the DEBA.

Example 2

Using the base test fluid from Example 1, i.e., the mineral oil base fluid and the various additives (but without any friction reducing additives or non-friction reducing additives) two additional test fluids were prepared. The additional test fluids contained the friction additives set forth in Table 2.

TABLE 2

| Test Fluid | Friction Reducing Additive, Wt. % | Non-Friction Reducing Additive, Wt. % |
|---|---|---|
| B-3 | thiobisethanol ester, 0.4% | DEBA, 0.1% |
| B-4 | thiobisethanol ester, 0.4% | DEBA, 0.2% |
| Base Fluid | None | None |

Figure 2:
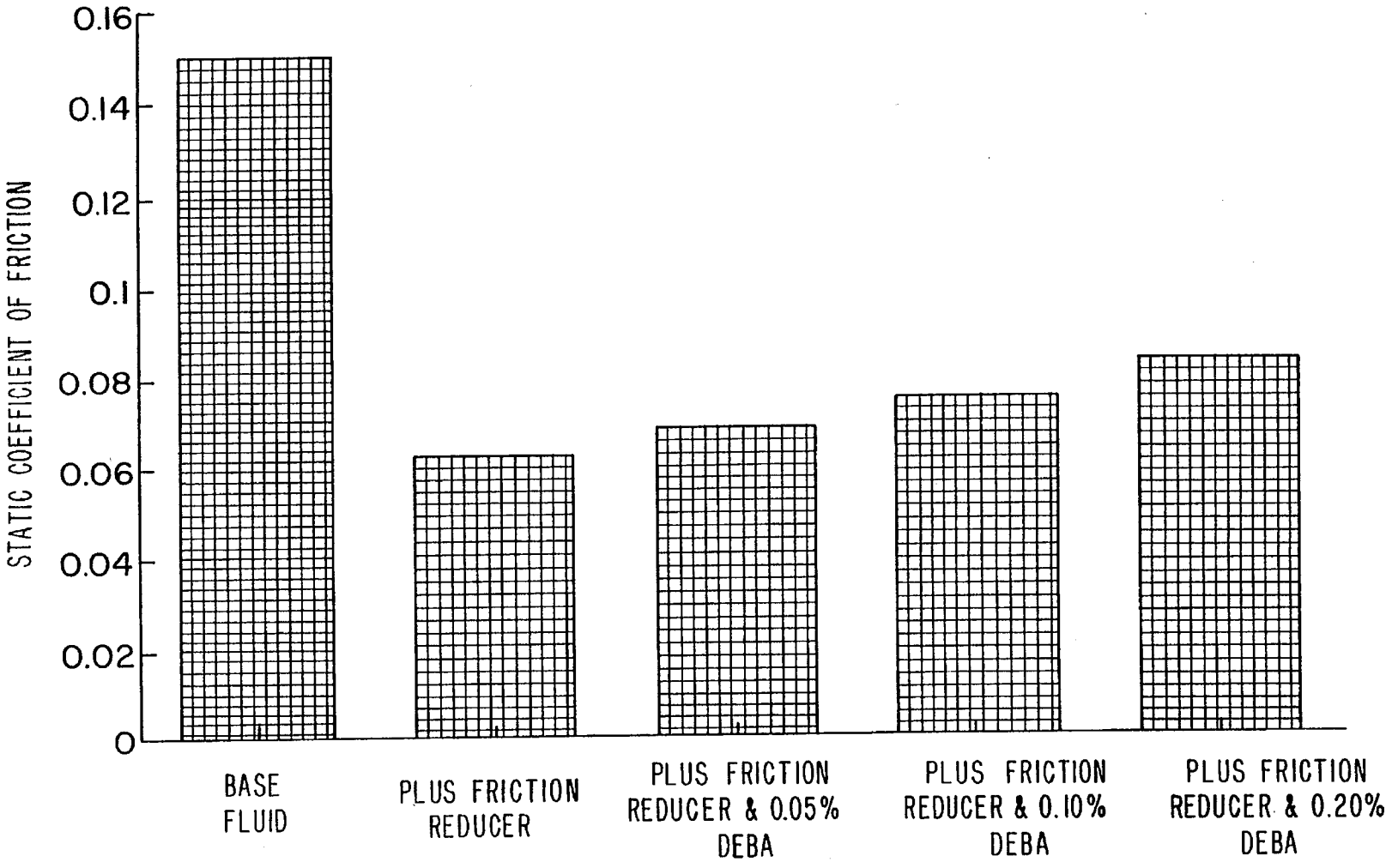
FIG. 2 is a bar graph illustrating the static coefficient of friction, determined at 149° C., using a LVFA, for (1) a base fluid, (2) the base fluid plus a friction reducer, (3) the base fluid plus a friction reducer and 0.05 wt. % DEBA, (4) the base fluid plus a friction reducer and 0.1 wt. % DEBA, and (5) the base fluid plus a friction reducer and 0.2 wt. % DEBA.

The static coefficient of blends B-1 through B-4, as well as that of the base test fluid blend (with no friction additives), was determined at 149° C. using the LVFA. The results of this testing are shown in FIG. 2. FIG. 2 shows that with increasing amounts of DEBA the static coefficient of friction continues to increase. Therefore, it should be possible to accurately select whatever static coefficient of friction is desired between 0.062 and 0.150 by using the appropriate amount of DEBA.

Example 3

Two more blends were prepared using the base test fluid blend described in Example 1, in combination with the amount of DEBA indicated in Table 3.

TABLE 3

| Test Fluid | Friction Reducing Additive, Wt. % | Non-Friction Reducing Additive, Wt. % |
|---|---|---|
| E-1 | None | DEBA, 0.05% |
| E-2 | None | DEBA, 0.1% |
| Base Fluid | None | None |

Figure 3:
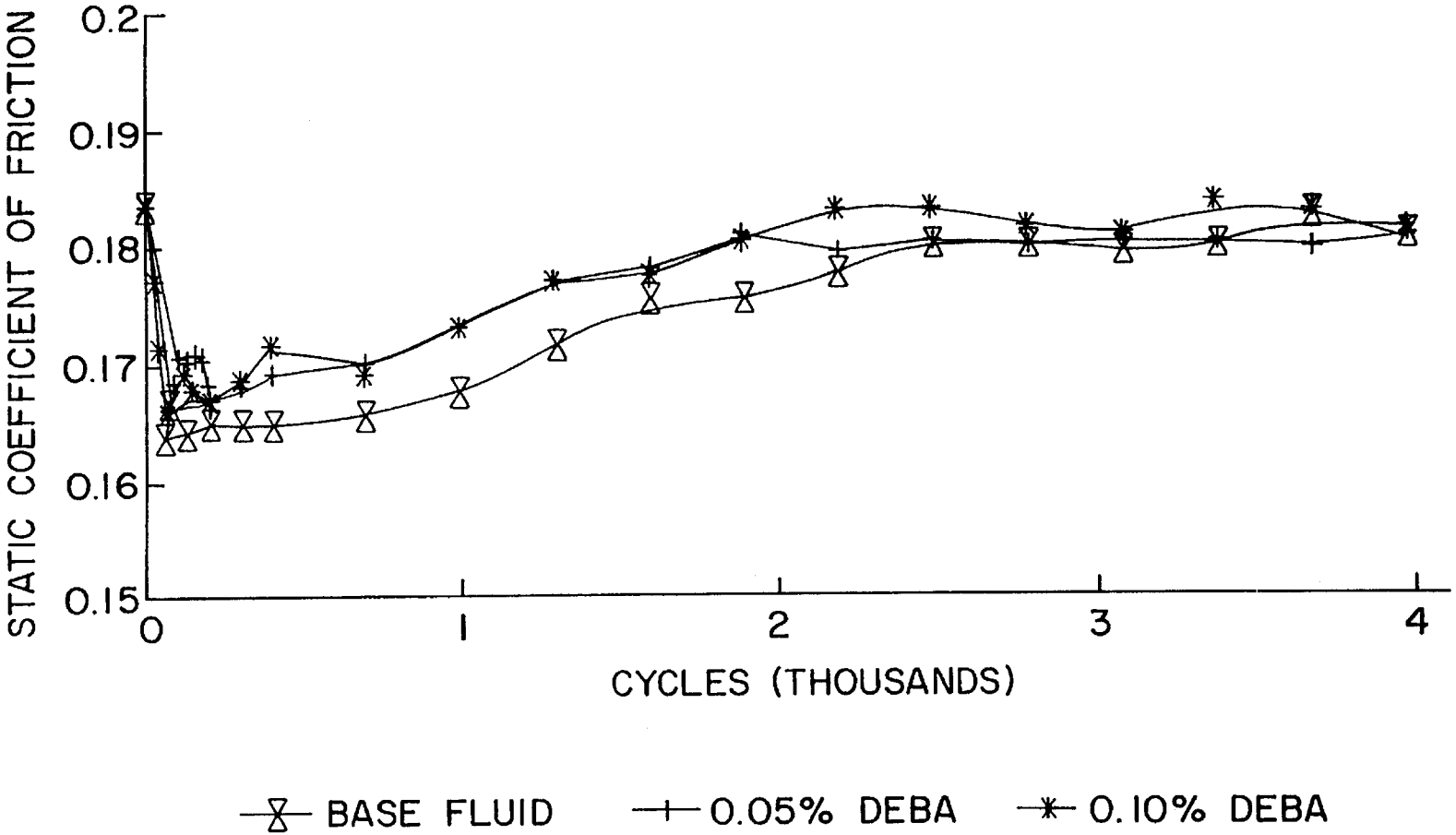
FIG. 3 is a graph illustrating the static coefficient of friction versus the number of test cycles as tested in the MERCON® 4,000 cycle friction test, as described in the FORD MOTOR COMPANY MERCON specification, of (1) a base fluid, (2) the base fluid plus 0.05 wt. % DEBA, and (3) the base fluid plus 0.1 wt. % DEBA.

These two fluids, along with the base blend, were tested in the MERCON® 4000 cycle friction test, as described in the Ford MERCON Specification dated May 1987, Section 3.8. The static coefficient of friction as determined in this test is plotted versus test cycles in FIG. 3. FIG. 3 shows that DEBA, in and of itself, is not a friction increaser. Rather, DEBA functions to increase the static friction of a fluid containing both DEBA and a friction reducing additive by competing for the friction surface with the friction reducing additive.

What is claimed is:

1. A method of controlling the friction coefficients and improving the friction durability of an oleaginous composition, which comprises:

adding to a major portion of an oil of lubricating viscosity a friction controlling and friction durability improving effective amount of an oil soluble combination of chemical additives comprising (a) a first chemical additive comprising a polar head group other than a dialkoxylated amino group and a friction reducing substituent group, wherein said polar head group contains an acylated nitrogen-containing compound, and (b) a second chemical additive having a dialkoxylated amino polar head group and non-friction reducing substituent group.

2. An oleaginous composition comprising a major amount of an oil of lubricating viscosity and an amount effective for controlling the friction coefficients and for improving the friction durability of said composition of an additive composition comprising (a) a first chemical additive comprising a polar head group other than a dialkoxylated amino group and a friction reducing substituent group, wherein said polar head group contains an acylated nitrogen-containing compound, and (b) a second chemical additive having a dialkoxylated amino polar head group and a non-friction reducing substituent group.

3. The composition of claim 2, wherein said first chemical additive (a) comprises basic friction reducing additives.

4. The composition of claim 3, wherein said first chemical additive (a) is selected from the group consisting of $—CONH_2$, $—CONH—(CH_2CH_2NH)_xC(O)R$, isostearic acid/TEPA, and mixtures thereof, wherein R represents a $C_1$ to $C_{30}$ linear or branched hydrocarbyl group and x represents an integer from 1 to about 8.

5. The composition of claim 3, wherein said second chemical additive (b) comprises a dialkoxylated $C_1$ to $C_{20}$ non-friction reducing hydrocarbylamine and wherein said first chemical additive (a) is free from any dialkoxylated amine moieties.

6. The composition of claim 5, wherein said second chemical additive (b) comprises diethoxylated n-butylamine.

7. The composition of claim 2, wherein said first chemical additive (a) comprises a substantially linear hydrocarbyl friction reducing substituent group containing at least 10 carbon atoms.

8. The composition of claim 2, wherein said second chemical additive (b) comprises a substantially hydrocarbyl non-friction reducing substituent group containing fewer than 10 carbon atoms.

9. An additive concentrate for controlling the absolute values of the friction coefficients and for improving the friction durability of an oleaginous composition which comprises: (i) a major amount of an oil of lubricating viscosity; and (ii) a combination of chemical additives comprising a first chemical additive (a) comprising a polar head group other than a dialkoxylated amino group, wherein said polar head group contains an acylated nitrogen-containing compound, and a second chemical additive (b) having a dialkoxylated amino polar head group and a non-friction reducing substituent group.

* * * * *